United States Patent [19]

Lowen

[11] Patent Number: 4,488,372

[45] Date of Patent: Dec. 18, 1984

[54] HEAD-MOUNTED MOTOR-DRIVEN UNIT

[75] Inventor: Stephen Lowen, New York, N.Y.

[73] Assignee: Nadel & Sons Toy Corp., New York, N.Y.

[21] Appl. No.: 430,723

[22] Filed: Sep. 30, 1982

[51] Int. Cl.[3] ..... A63H 33/00

[52] U.S. Cl. ..... 446/27

[58] Field of Search ..... 46/1 F, 269, 248, 47, 46/53, 58; 2/199, 185 R

[56] References Cited

U.S. PATENT DOCUMENTS

| | | | |
|---|---|---|---|
| D. 155,437 | 10/1949 | Molin et al. | 46/53 UX |
| 2,849,007 | 8/1958 | Behr | 2/199 UX |
| 4,141,083 | 2/1979 | Waters | 2/199 X |

*Primary Examiner*—Mickey Yu

*Attorney, Agent, or Firm*—Stempler & Cobrin

[57] ABSTRACT

An attention-attracting unit comprising a head-mountable clasp which carries a light-weight D.C. motor with a small light-weight battery alongside it, the motor having an output shaft which is vertical when the clasp is on a wearer's head, and has connected to it a rod on the opposite ends of which large light-weight ornaments are attached, so that the rod, together with the ornaments, turns about the center of the shaft at a speed slow enough to permit the ornaments to be viewed as they rotate, without danger of harming either the person wearing the unit or any nearby persons or things, the unit being fully self-contained.

2 Claims, 3 Drawing Figures

HEAD-MOUNTED MOTOR-DRIVEN UNIT

BACKGROUND OF THE INVENTION

1. Field of the Invention

The present invention relates, in general, to prehensilely head-attached attractive articles of personal adornment for children of all ages.

2. Description of the Prior Art

More specifically, the present invention is in the field of head ornaments of the type which are held on a person's head, usually a child's head, prehensilely. However, the field may be considered somewhat broader and, as such, might embrace patents like U.S. Pat. Nos. 2,679,711 (Learnard); 3,216,149 (Briese); 3,491,374 (Frangos); and 3,184,884 (Petrucelli).

Learnard discloses a skeletonized Indian headdress with a first band that circumscribes the forehead and back of a wearer's head, and a second band that runs from the front to the back of the circumscribing band. The second band carries a rearwardly tilted upwardly extending spindle that supports a hub from which feathers radially project. The feathers are intended to catch the wind and to cause rotation.

Briese shows a beanie held in position by a chin strap. The beanie mounts a pair of upright support arms which, between them, support a shaft on which a rotor turns. The wearer expends physical energy to turn the rotor.

Frangos illustrates a visored cap that on a cross-band supports one or more propellers turning about vertical axes. At least one propeller is rotated by a flexible shaft energized by a remote, battery-driven motor that is either hand held or carried in a wearer's pocket. It is not intended that the battery/motor be on the wearer's head.

Lastly, Petrucelli reveals a band that runs from the top of a wearer's head, down the sides of the head and is held in place by a chin strap. The band carries a vertical support from the tip of which a cord protrudes. The cord acts as a tether to the free end of which a pendant is attached. The pendant is actuated by the user to swing it in the direction of a target within the permitted radius of movement, and the pendant may be freely rotated by torsional movement of the user's head.

Another item of possible interest is U.S. Pat. No. 3,376,664 (Sauer) in which a flat star ornament is supported atop an upright pedestal by a pin that is stabilized by a pair of rigidly-spread hanging balls.

There are also in the prior art, although not believed to be of direct relevance, various patents showing fans supported atop a person's head as parts of units in which the fans direct cooling air onto a person's head. Patents illustrating such arrangements are U.S. Pat. Nos. 3,376,664; 3,881,198; 3,391,407; and French Patent-of-Addition No. 72,506 to French Patent No. 752,321.

Lastly, there is a craze currently pervading the United States of a ubiquitous, prehensile ornamental device that found great favor with young children. This constitutes ornamental items held in place on a wearer's head by a pair of opposed prehensile, usually plastic, bands, that support various kinds or ornamental pieces. Sometimes the ornamental pieces are figurines; sometimes they are held in place rigidly; sometimes there are several pieces on a single item; sometimes there is only a single piece per item; sometimes the pieces are supported on the item at the ends of readily-yieldable coil springs. Typical of such pieces are light-weight balls (pompons), gaily colored plastic differently shaped objects, etc. These apparently constitute a major object of attraction, particularly for young children, but whose desirability has reached the older generation and the presence of which is not unheard of at sundry festive events.

SUMMARY OF THE INVENTION

1. Purposes of the Invention

It is an object of the invention to provide a unit of the character described having an attractive appearance which is self-animated but which is light enough in weight to be worn on a child's head for as long as the child wishes without the weight thereof ever becoming burdensome.

It is another object of the invention to provide a unit of the character described which will operate reliably but at a rate of movement slow enough so that it will not harm inanimate objects or the wearer or any other humans with which the moving parts of the object may come in contact inadvertently.

It is another object of the invention to provide a unit of the character described which can be made by mass production methods at a low cost with unskilled help.

It is another object of the invention to provide a unit of the character described which is of rugged construction so that it can withstand the vicissitudes of hard-handling and knock-about play to which a young child ineveitably will put it.

It is another object of the invention to provide a unit of the character described which a child can properly position on its head without requiring specific instructions, that is to say, which is so configured that is has only one proper mode of placement which is immediately apparent simply upon inspection of the unit.

It is another object of the invention to provide a unit of the character described which can be shipped in knocked-down condition so as to occupy a minimum of shipping space, and thereafter readily and quickly assembled at its point of destination.

It is another object of the invention to provide a unit of the character described which is wholly self-contained.

Other objects of the invention in part will be obvious and in part will be pointed out hereinafter.

2. Brief Description of the Invention

In keeping with the foregoing objects, the disco unit comprises a light-weight frame which, although it can be made from metal wire, preferably is fabricated from plastic, for example, by injection molding, the plastic selected being such that, for the dimensions of the frame selected, the frame is resilient. The frame is so configured as to provide a headband, namely, a band having a portion that crosses over the top of the head approximately midway between front and back, and has end portions, namely, terminal portions, descending down the sides of the head over the temples. The frame in its as-molded condition has the terminal portions adjacent each other, i.e. spaced close together, or, more specifically, closer to each other than are the temples of the wearer. However, the terminal portions can be spread apart because of the resiliency of the frame, but in so spreading the frame, although little effort is needed, stresses can be set up in the frame, as a result of which the opened frame will have its terminal portions biased toward closing and thereby will press lightly against the temples of the wearer to hold the frame in place on the wearer's head. The pressure is very slight and is not such as to be uncomfortable. The total weight of the frame is very small.

The inner surface of the frame may be, and preferably is, provided with several radially inwardly projecting squat pin-like protuberances of extremely slight length, e.g. 1/16" long, the purpose of which is better to anchor the frame in the hair of the head and thereby inhibit movement of the frame.

The frame supports a centrally located, upwardly extending, low-voltage, low-wattage, low-power, low-torque, easily stallable D.C. motor. The motor is inexpensive and weighs very little. A typical motor is a 1½ volt motor such as can be purchased from the American affiliate of Mabuchi Motors of Japan. The motor is physically small. It is generally cylindrical and is about ¾" in diameter and about 1" high. It has a protruding vertical output shaft which extends upwardly about ⅜" from the motor housing. The shaft is about 1/16" in diameter. When the motor is energized by a 1½ volt battery, as it is intended to be, and the shaft is held by a persons's fingers, the motor is prevented from turning, but it will not overheat nor will it burn out. The motor is used to animate an ornamental display carried by the frame and the motor, inasmuch as the motor is supported by the frame.

In the preferred form of the invention and the one shown herein, the ornamental display constitutes a transparent plastic horizontal rod approximately 9½" long having a transverse vertical bore at its center. The bore is dimensioned to receive the output shaft of the motor. As noted earlier, the motor is shipped separately from the ornamental display, i.e. separately from the transparent rod. The bore is of the proper dimensions for the shaft to be tightly received therein when the rod is mounted on the output shaft, so that once the two are assembled, they will not come apart easily. The transverse configuration, i.e. cross-section, of the rod is of no importance and, as illustrated, is square.

Preferably, ornamental objects are carried by the ends of the rod. In the particular example, the ornamental objects are pompons, that is to say, ornamental balls of spherical external configuration, each constituting a mass of fibers extending away from a common center at which the fibers are attached as by cementing to an associated end of the rod.

The bore in the rod need not be at the exact center, nor need the pompons be exactly of the same weight, because the rod is not balanced on the output shaft; nor does the rod or the objects carried at the ends thereof turn at a sufficiently high rotational speed to create noticeable vibrations caused by an imperfect balance. A typical speed of rotation is approximately 30 rpm.

For convenience of assembly and ruggedness of structure, the motor is cemented to a platform which, in turn, is cemented to the center of the frame, and a battery casing that contains a battery connected by lead wires to the motor likewise is cemented to the same platform in the vicinity of the motor. Desirably, the battery casing includes a cover so that the battery is concealed and protected. The cover, of course, is removable to permit the battery to be changed when it is depleted. The battery is connected to the motor in a series circuit that includes a manually operable switch secured to the casing in a location readily accessible to the fingers of the wearer of the unit.

The rod and pompons together weigh approximately ½ oz. The motor, casing and switch together weigh slightly more than ½ oz. The frame and the platform together weigh about ½ oz. The total weight of the unit, including the frame and the platform, the motor, the battery casing and the switch, and the rod and the pompons is slightly more than 1½ oz. but short of 2 oz., this being exclusive of the battery which is an AA battery. It thus will be appreciated that the weight of the unit carried atop a wearer's head is so slight as not to be oppressive, even for a young child, and is sufficiently small that he can carry about the unit for hours without tiring from it.

The invention consists in the features of construction, combinations of elements, and arrangements of parts which will be exemplified in the device hereinafter described and of which the scope of application will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENT

Figures 1, 2, 3:
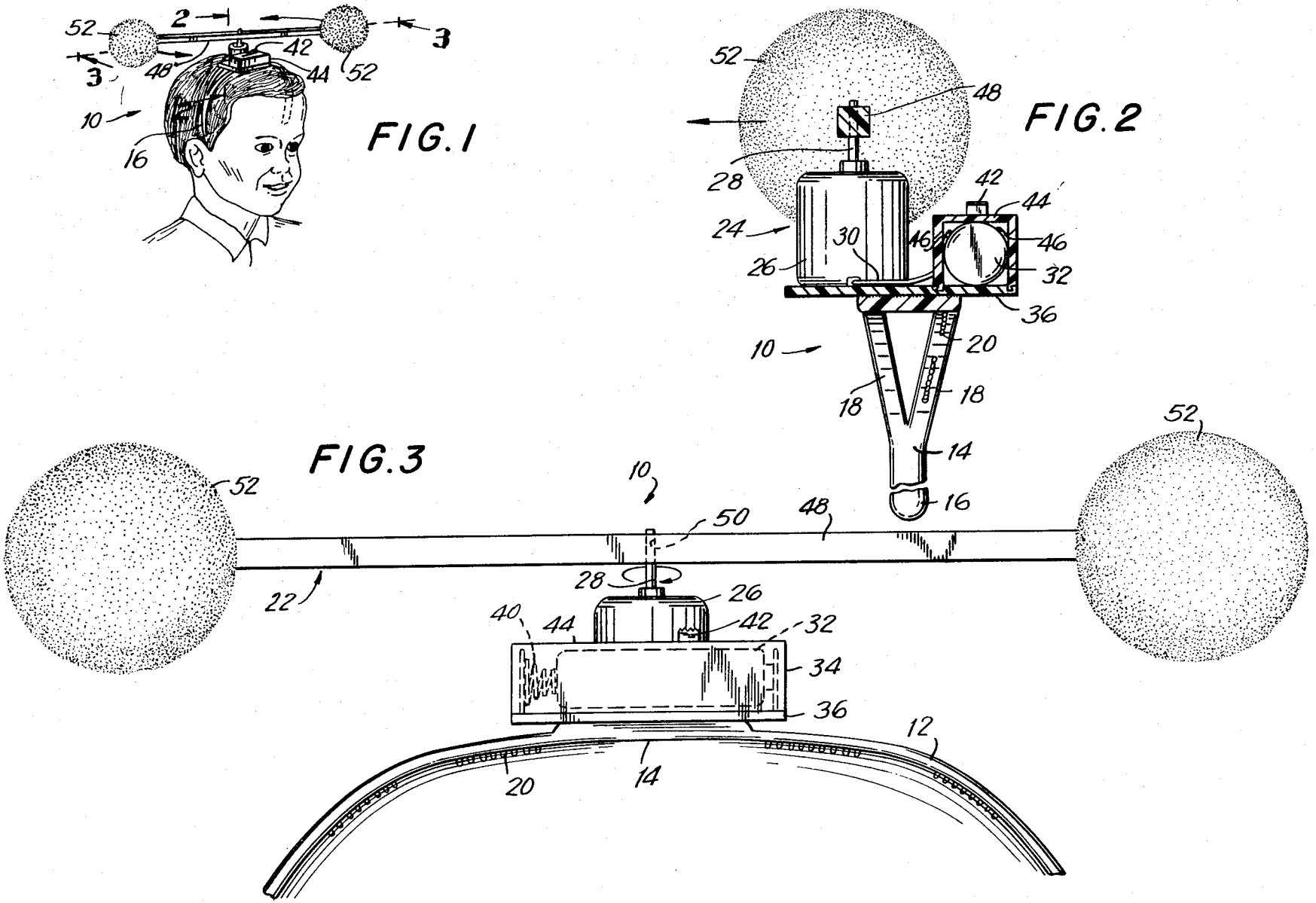
FIG. 1 is a sketch showing the unit in place on a child's head.
FIGS. 2 and 3 are sectional views taken substantially along the lines 2—2 and 3—3 of FIG. 1.

Referring now in detail to the drawings, the numeral 10 denotes a disco unit constructed in accordance with and embodying the present invention. This is a unit which is intended to be mounted, and is shown so mounted, on the head of a person, usually on the head of a young child, typically a child in the age group from 3 to 12, although this is not intended to be exclusive of ages above or below the same; indeed, many adults derive some pleasure from wearing disco units of the type under consideration.

The unit includes a head-mounting means in the form of a light-weight frame 12. It is contemplated that this frame can be made in any suitable manner which is such that it does not impose a cumbersome weight on a wearer's head, preferably not a weight in excess of a few, e.g. 4 or 5, oz., and preferably does not exert too much pressure on a wearer's temples, again not more than a few oz. of pressure, e.g. not more than 4 or 5 oz.

Accordingly, one of the materials whose use is envisioned in constructing the light-weight frame is metal, for example, a steel wire frame bent into the shape of a horseshoe. However, in the preferred form of the invention, the form herein illustrated, the light-weight frame is made of a plastic material, to wit, a plastic elastomeric material, typical such materials being polypropylene, polyethylene and polyurethane, all of these being selected from the classes of such chemical compounds which are resilient or which have added to the polymers or resins plasticizers to render the same sufficiently resilient for the purposes mentioned; that is to say, which will impart to the plastic material, one of the form and dimensions about to be described, a plastic memory which, after the plastic has been set after being molded, e.g. injection molded, will, when deformed somewhat out of shape, have an elastic memory which will be biased to its as-molded configuration.

Typically, a plastic injection-molded frame will have a radius of curvature of approximately 2" and a thickness of approximately 1/16". Actually, the frame may be considered as constituting three portions, one of these being the central portion 14 which is the portion from approximately the top of the frame to roughly half-way down to the free ends of the frame, the other being the remainder of the frame which constitutes the temple portions 16. The widths of the temple portions are about ¼". The frame is bifurcated at the tops of the temple portions, i.e. split into two arms 18 which run separately across the top of the head, each arm being approximately one-half the width of the associated temple portion, i.e. ⅛". It should be emphasized that the dimensions that have just been mentioned are only approximate and have been given only by way of example and are not to be considered as either critical or limiting upon the invention.

The distance between the two separate parts of the frame which cross over the head and are joined at the tops of the temple portions is, at the center of the frame, approximately ½". This measurement likewise is given by way of example and is not to be considered in any way as limiting upon the invention.

The undersurface of the central portion of the frame may be provided with tiny protuberances, i.e. tiny squat teeth 20, which are close to one another. The teeth are quite short, a typical tooth being 1/16" in length radially of the frame, and the teeth being approximately 3/32" in center-to-center spacing. Such dimensions likewise are merely exemplificative and not limiting. The function of these teeth has been mentioned earlier under the brief description, their purpose being to firmly anchor the frame in the hair of the wearer's head so as to prevent inadvertent shifting of the frame and the decorative object or objects carried thereby.

The total weight of the frame is quite slight and, if made of plastic, is in the neighborhood of approximately ½ oz., so that it will be appreciated that such a small weight carried about on a wearer's head can be sustained without discomfort for a very long period of time. Indeed, within a very few seconds after donning the frame, even if the frame supports some other lightweight elements subsequently to be described in detail, the wearer will not even notice that the same is emplaced on his head except by the attention that he attracts.

It will be appreciated that the frame in its as-molded condition has the free ends of the temple portions quite close to each other and, indeed, they may cross over each other. However, it requires extremely little effort to spread the free ends of the temple portions. The frame is mounted on the head of a wearer by spreading apart the free ends of the temple portions manually a distance sufficient to enable the frame to be placed on a person's head in a position in which the central portion crosses the top of a person's head and the free ends of the temple portions are on opposite sides of a person's temples. Then when the temple portions are released, the temple portions will spring toward each other to press lightly against the sides of the person's head. The pressure exerted by these temple portions at such time is so light as to be barely noticeable. Such pressure usually is in the vicinity of a few oz., e.g. 1 or 2 oz., and it is not more noticeable to the wearer than is the weight of the frame and the elements carried by the frame.

The frame serves as a mounting means for an animated display 22 and a driving means 24 for said display. Any suitable alternate mounting means may be employed, e.g. a beanie or a hat.

More specifically, as observed hereinabove, the driving means for the display includes an inexpensive, low-voltage, low-wattage, low-torque, easily-stallable D.C. motor 26 of light weight, like the one made by the American affiliate of Mabushi Motors of Japan. A typical motor of this type has an output shaft 28. The output torque of the motor is so low that the motor can be held back against rotation by simply gripping the shaft between a person's fingers and, when so gripped, not only will the motor not turn but it will not overheat and will not burn out. If not restrained, the shaft spins at quite a low rate of speed. Under the load which is described subsequently, the motor turns at approximately 30 rpm.

The motor has a pair of input leads 30 connected to an energizing circuit described in the following portion of this specification, and which includes a dry cell, viz., a 1½ volt, light-weight size AA battery 32 contained in a housing 34. The housing is supported by a panel 36 made, for example, of plastic material, and secured as by plastic cement to the central portion 14 of the lightweight frame 12 in a position in which the panel is substantially horizontal when the frame is mounted on a person's head and the person's head is erect, as shown in FIG. 1. The base of the motor likewise is secured in the same manner, i.e. by plastic cement, to said panel, the same being preferably close to the battery housing.

The battery housing contains the usual contact terminals to engage the battery terminals, one of the contact terminals for the battery being in the form of a stationary plate 38 and the other being in the form of a spiral spring 40. The input leads 30 connect the motor terminals to the battery contact terminals. Desirably, an OFF/ON switch 42 is included, the same being interposed in one of the input leads 30 and the control for the switch 42 being mounted on the battery housing 34 in a position convenient for manipulation by the wearer of the disco unit 10.

As a matter of appearance, it is desirable to provide the battery housing 34 with a cover 44 which is detachably connected to the housing. The particular method of attachment of the cover is not of critical importance. Any suitable arrangement can be employed for this purpose; for instance, the cover can include a pair of resilient arms which snap onto the ends of the housing to hold the cover in place.

Additionally, the battery housing includes a pair of resilient arms 46 which are disposed at the sides of the housing and extend away from the housing base and over the battery when the battery is positioned in the housing in order to hold the battery in the housing and prevent its inadvertent displacement, rather than to rely upon the cover for that purpose.

The animated display 22 may assume any one of various forms but, in general, should be quite light in weight and esthetic in appearance and capable of moving in a manner which is appealing to a child. Exemplificative of the forms that the animated display may take are figurines with fixed appendages, figurines with posable appendages, figurines with articulatable appendages, stars, balls, discs, dice and other geometric shapes, banners, streamers, feathers, fluorescent and phosphorescent objects, other decorative ornaments in general, etc., all of these being characterized by small size and light weight, the weights of all the forms never exceeding, in toto, a few, e.g. 2 to 3, oz. The forms are carried in some suitable manner by and from the output shaft 29 and, in the display 22 being described and shown, the support constitutes a 10" plastic rod 48 of square cross-section which at its center is formed with a transverse bore 50 of the proper diameter to tightly receive said shaft so that the shaft can be shipped separately from the frame on which the panel, battery housing and motor are mounted in knocked-down condition and subsequently mounted by a sales person or by a purchaser. The forms are secured to the opposite ends of the rod.

A form which has been found to be particularly attractive in appearance, light in weight and inexpensive is a pompon 52, that is to say, a pair of pompons, one at each end of the plastic rod 48. The pompons are conventional, fluffy balls of negligible weight composed of a multiplicity of fine-denier strands emanating from a core to which they are secured, for example, by cement, the core in turn being held to the rod in a like manner, e.g. by cement. The free ends of the strands are trimmed to a common radius so as to form a 3" ball. The strands of a given pompon may be of a single color or may be vari-colored.

The unit usually is shipped in knocked-down condition with the rod off the motor shaft. The retailer ordinarily will assemble the rod on the motor shaft to form a completed unit. The motor switch will be left in OFF position.

In use, after the unit has been purchased, it will be placed on a person's head with the temple portions forward of the ears and the central portion crossing over the top of the head but firmly seated against the hair. Then the user will manipulate the switch to activate the motor so that the balls will turn with the rod about the motor shaft. The rate of rotation is rather slow, in the given case about 30 rpm, which is slow enough so that the path of the balls can be followed by eye. In other words, the balls are not spun so fast that if the user puts his hand in the path of travel of the balls or in the path of travel of the rod his hand can be hurt, for instance, bruised. If he should put his hand or a portion thereof in the path of travel of the rod, the rod will simply come to an immediate halt. Stopping the rod in this fashion does not damage the motor. The motor can be stopped in this fashion with power left on without doing any harm to the motor.

Nor are the rods or balls capable of damaging inanimate objects that they may strike because their weight is too low and their momentum is too small to do damage.

However, the constant motion of the rod and of the attention-attracting ornaments carried by it create a very appealing appearance which boosts the ego of the child wearing the same and makes him feel that he is the center of attraction.

As mentioned several times earlier, the very light weight of the item enables a child to wear the unit for long periods of time without discomfort.

It thus will be seen that there is provided a device which achieves the various objects of the invention and which is well adapted to meet the conditions of practical use.

As various possible embodiments might be made of the above invention, and as various changes might be made in the embodiment above set forth, it is to be understood that all matter herein described or shwon in the accompanying drawings is to be interpreted as illustrative and not in a limiting sense.

Having described the invention, there is claimed as new and desired to be secured by Letters Patent:

1. A heat-mountable, esthetic, attention-attracting unit having slow-moving, low-torque, easily stallable, safe, non-bruising, large rotary elements animated by a self-contained, compact, portable, lightweight source of motor power, said unit comprising a head-mounting means, an animated display, and a driving means for said display; said driving means including a low-voltage, low-wattage, low-torque, lightweight, small, easily stallable D.C. motor having an output shaft; said head-mounting means including a lightweight frame constituting three portions of which one is a central portion having opposite ends, and the remaining two are temple portions of said mounting means being resilient whereby said mounting means may be placed on a person's head with the central portion thereof atop the person's head and the temple portions lightly pressing against the sides of the person's head; said animated display comprising a lightweight object, lightweight structure supporting said object from said mounting means, said structure including a portion supported by and movable relative to said mounting means, said driving means moving said structure relative to said mounting means, said animated display being two lightweight, attention-getting objects located at the opposite ends of and held by an elongated member secured adjacent its center to the output shaft; means securing the motor to the central portion of the head-mounting means with the output shaft disposed vertically when the frame is on the person's head in the position previously described; said structure having a bore therein, said output shaft tightly fitting in said bore whereby to connect the structure to the motor, and a battery container adjacent the motor with a lightweight battery therein for energizing the motor, said battery container including a detachable cover to enable a person to replace a spent battery, internal resilient arms located within said battery container to prevent inadvertent displacement of the battery; the frame, the animated display and the driving means having a slight total weight and being totally self-contained, including its own source of power, a panel being secured on the head-mounting means and the display and driving means being secured to the top of the panel.

2. A unit as set forth in claim 1 further including a manipulatable switch for selectively isolating the D.C. motor and the battery physically carried by the unit.

* * * * *